US007781982B2

(12) United States Patent
Tatsumi

(10) Patent No.: US 7,781,982 B2
(45) Date of Patent: Aug. 24, 2010

(54) LOW-VOLTAGE POWER SUPPLY CIRCUIT FOR ILLUMINATION, ILLUMINATION DEVICE, AND LOW-VOLTAGE POWER SUPPLY OUTPUT METHOD FOR ILLUMINATION

(75) Inventor: Naoki Tatsumi, Shinagawa-ku (JP)

(73) Assignee: NEC Lighting, Ltd, Tokyo (JP)

( * ) Notice: Subject to any disclaimer, the term of this patent is extended or adjusted under 35 U.S.C. 154(b) by 951 days.

(21) Appl. No.: 11/521,517

(22) Filed: Sep. 15, 2006

(65) Prior Publication Data

US 2007/0152604 A1 Jul. 5, 2007

(30) Foreign Application Priority Data

Sep. 16, 2005 (JP) ..... 2005-270004

(51) Int. Cl.
*G05F 1/00* (2006.01)

(52) U.S. Cl. ..... 315/291; 315/247; 315/224; 315/282; 315/307; 363/124

(58) Field of Classification Search ..... 315/247, 315/225, 224, 276, 282, 291, 307, 362, 312; 363/80, 89, 97, 124, 126

See application file for complete search history.

(56) References Cited

U.S. PATENT DOCUMENTS

| | | | | |
|---|---|---|---|---|
| 5,661,645 | A * | 8/1997 | Hochstein | 363/89 |
| 6,091,614 | A * | 7/2000 | Malenfant | 363/97 |
| 7,161,307 | B2 * | 1/2007 | Chen | 315/247 |
| 7,256,554 | B2 * | 8/2007 | Lys | 315/291 |
| 7,598,685 | B1 * | 10/2009 | Shteynberg et al. | 315/308 |
| 2008/0315783 | A1 * | 12/2008 | Inaba | 315/247 |

FOREIGN PATENT DOCUMENTS

| | | |
|---|---|---|
| KR | 2001-0079315 A | 8/2001 |
| WO | WO 01/60129 A | 8/2001 |

* cited by examiner

*Primary Examiner*—Haissa Philogene
(74) *Attorney, Agent, or Firm*—Sughrue Mion, PLLC

(57) ABSTRACT

In a low-voltage power supply circuit for illumination that rectifies an ac power supply by means of a rectifier circuit, that controls this rectified output by means of a power-factor control circuit, and that supplies a low-voltage power supply for illumination, the power-factor control circuit is composed of a step-down circuit and is further provided with a current-limiting capability.

8 Claims, 7 Drawing Sheets

PRIOR ART

PRIOR ART

PRIOR ART

LOW-VOLTAGE POWER SUPPLY CIRCUIT FOR ILLUMINATION, ILLUMINATION DEVICE, AND LOW-VOLTAGE POWER SUPPLY OUTPUT METHOD FOR ILLUMINATION

BACKGROUND OF THE INVENTION

1. Field of the Invention

The present invention relates to a low-voltage power supply circuit for illumination, an illumination device, and a low-voltage power supply output method for illumination, and more particularly to a low-voltage power supply circuit for illumination, an illumination device, and a low-voltage power supply output method for illumination that uses a delighted light source such as an organic EL or LED.

2. Description of the Related Art

The development of high-luminance LEDs and organic ELs is currently progressing and these devices will soon find use for the purpose of illumination. Although high-luminance LEDs and organic ELs still lack the luminous efficacy of fluorescent lamps, they are said to offer smaller size, thinner construction, and longer life, and above all, enable elimination of the use of mercury, and therefore hold promise as a light source for illumination.

Both high-luminance LEDs and organic ELs are dc-driven elements and emit light by means of the flow of dc current in these dc drive elements. As a result, in order to use a residential ac power supply to cause these dc-driven elements to emit light requires a power supply that converts an ac power supply to a dc power supply. In addition, high-luminance LEDs and organic ELs are devices that emit light with stability by means of the flow of a constant current and therefore necessitate a circuit for limiting current. Unless the luminous efficacy of these dc-driven elements is dramatically improved, the use of these dc-driven elements as illumination devices requires power on the order of 50-200 W.

A high-power illumination device must be provided with a power-factor improvement circuit. In the prior art, the power-factor improvement circuit that is typically used is of the booster type. When the power supply is 100V, this power-factor improvement circuit supplies as an output voltage a dc voltage of 200-300V and therefore cannot be used as is for a low-voltage element such as an LED. As a result, the least complex method is to both limit this dc voltage output to a constant current by a current-limiting circuit and reduce the voltage to the drive voltage of the LED to light the LED. However, this solution not only results in an increase in circuit scale but also creates problems for reducing cost.

The power-factor improvement circuit that is used in the prior art is a booster circuit, and the output voltage must therefore be higher than the maximum instantaneous value of the ac power supply voltage VAC. For example, when the power supply voltage is 100V, the output voltage is set to 200V-300V. On the other hand, the forward voltage drop of an LED is 2-4V and the forward voltage drop of an organic EL is as low as 10-20V, and the excessively high output voltage of a power-factor improvement circuit therefore complicates the direct drive of these elements even when a plurality of elements are driven in a series by the power-factor improvement circuit.

Accordingly, examples of the prior art required the insertion of a constant-current circuit in a stage following the power-factor improvement circuit for simultaneously supplying a constant current to the load such as an LED and lowering the high output voltage of the power-factor improvement circuit to the low drive voltage of loads such as LEDs.

Accordingly, the prior art entailed the problems of a complex circuit, an increased number of components, and the inability to lower costs.

FIG. 1 is a block diagram showing the circuit configuration of the first example of the prior art. Approximately the left half of FIG. 1 is the power-factor improvement circuit, and approximately the right half of FIG. 1 is the constant-current circuit. In addition, FIG. 2*a* is a block diagram of the power-factor control circuit shown in FIG. 1, and FIG. 2*b* is a block diagram of the current control circuit shown in FIG. 1. FIGS. 3*a*-3*f* are waveform charts for explaining the operation of FIGS. 1, 2*a*, and 2*b*.

The principle components of the power-factor improvement circuit of FIG. 1 are: diode bridge 1, transformer T1, switch element Q1, power-factor control circuit 2*a* for controlling this switch element Q1, and output filter 3. This power-factor improvement circuit controls the phase of AC power supply voltage VAC (FIG. 3*a*) and power supply current IAC to improve the power factor. Output voltage 7 of the power-factor improvement circuit is supplied to the constant-current circuit that is approximately the right half of FIG. 1, and the LED current ILED that flows to the LED of load 6 is controlled to a constant value.

FIG. 2*a* is a block diagram for explaining the details of power-factor control circuit 2*a* shown in FIG. 1. This power-factor control circuit 2*a* is made up from: multiplier 11, reference power supply 12*a*, error amplifier 14*a*, comparator 16*a*, driver 17*a*, zero-current detector 18, and flip-flop 19.

Output V7 of the power-factor improvement circuit is fed back to power-factor control circuit 2*a* of the control IC as output partial voltage V3 (FIG. 3*c*) that has undergone voltage division by resistor R5 and resistor R6. This output partial voltage V3 is compared with a reference voltage of reference power supply 12*a* at error amplifier 14*a*, and the difference is amplified and applied to one of the input terminals of multiplier 11. Voltage V2 (FIG. 3*b*), which is obtained by subjecting VAC, which is the AC input, to full-wave rectification by diode bridge (D1) and then voltage-division to an appropriate value by resistor R1 and resistor R2, is applied to the other input terminal of multiplier 11. Multiplier 11 generates voltage V4 (FIG. 3*d*), which is the result of multiplying these voltages, and supplies this result to one terminal of comparator 16*a*. Accordingly, the output V4 of multiplier 11, is voltage similar to AC power supply voltage VAC and has an amplitude that is proportional to output voltage V7 of power-factor improvement circuit.

Converted voltage V8 (FIG. 3*d*), which is obtained by converting the current value IQ1 that flows to switch element Q1 to a voltage value by resistor R6, is applied to the other input terminal of comparator 16*a*. Switch element Q1 turns ON during the interval from the time that the current IT1 that flows to transformer T1 becomes "0" to the time that converted voltage V8 reaches the level of multiplied voltage V4. During this time interval, the current increases substantially linearly, but the proportion of this increase is determined by the primary inductance of transformer T1 and the instantaneous value of power supply voltage VAC.

When the above-described ON interval ends and switch element Q1 turns OFF, the current that flows to switch element Q1 becomes "0" instantaneously and a sawtooth wave is produced, but after the attenuated current that is determined by the primary inductance flows to the primary coil of transformer T1 for a certain interval, a current flows that becomes "0" (IT1 of FIG. 3*e*). This transformer T1 also implements zero-current detection, and at the same time, has the function for converting energy (i.e., conversion of voltage) as the inductance of a booster chopper circuit.

By repetition of this process, an interrupted current having a triangular wave flows to the primary coil of transformer T1. By selecting components to achieve a frequency sufficiently higher than the frequency of VAC, the high frequency of voltage V8 is normally 20-200 kHz.

The output of comparator 16*a* is supplied to the reset terminal of flip-flop 19. This flip-flop 19 sets switch element Q1 to ON during the interval that it is set. The above-described voltage V4 and voltage V8 are compared by this comparator 16*a*, and when voltage V8 surpasses voltage V4, the output of comparator 16*a* inverts, flip-flop 19 is reset, and switch element Q1 turns OFF.

At the instant switch element Q1 turns OFF, counter-electromotive force is generated at the primary coil of transformer T1, passes through diode D3 and charges capacitor C3. During the interval that this charge current flows, current IT1 that gradually attenuates continues to flow to the primary coil of transformer T1 even after switch element Q1 turns OFF.

The change to "0" of current IT1 that flows to the primary coil of transformer T1 is detected by the secondary coil of transformer T1 and zero-current detector 18. Upon detecting that current IT1 has become "0," zero-current detector 18 resets flip-flop 19, whereby switch element Q1 turns ON.

Through the repetition of the above-described operations, the phase of the average value of current IT1 that flows to the primary coil of transformer T1, i.e., power supply input current IAC, becomes equal to the phase of AC power supply voltage VAC (FIG. 3*f*), and the power factor is controlled to substantially "1."

In addition, because its output voltage V7 is fed back to power-factor control circuit 2*a*, the output voltage V7 of power-factor control circuit 2*a* is controlled to a substantially constant value, the size of this output voltage V7 normally being set to 200-300V when the AC power supply voltage is 100V.

In addition, the constant-current circuit portion is made up from the widely used chopper-type step-down circuit, and is made up from: current control circuit 7, switch element Q2, and output filter 3. FIG. 2*b* is a block diagram for explaining the details of current control circuit 7 shown in FIG. 1. This current control circuit 7 is made up from: reference power supply 22, error amplifier 23, sawtooth-wave oscillator 21, comparator 24, and driver 25.

Current control circuit 7 detects the load current as voltage V9 by means of resistor R4, and applies this current to one terminal of error amplifier 23. The reference voltage from reference power supply 22 is applied as input to the other terminal of error amplifier 23. The output of this error amplifier 23 is compared with the output of sawtooth-wave oscillator 21 in comparator 24, and the output of comparator 24 is supplied as output by way of driver 25 to drive switch element Q2.

This switch element Q2 is a chopper-type step-down circuit. Current control circuit 7, by feeding back voltage V9 that is a voltage obtained by converting load (LED) current ILED by resistor R4, maintains LED current ILED at a constant value and simultaneously supplies a low voltage appropriate for driving an LED.

As described in the foregoing explanation, the circuit of the first example of the prior art inserts a constant-current circuit in a stage following the power-factor improvement circuit, steps down the high output voltage, and supplies a constant current to a load such as an LED. As a result, the formation of this circuit requires high withstand-voltage components such as the switch elements, diodes, coils, and large-scale capacitors, and the device consequently has the drawback of large size. In other words, this device entails the problems of complex circuit, increased number of components, and the inability to lower costs.

The second example of the prior art is the discharge lamp lighting device disclosed in WO2001-60129. This discharge lamp lighting device simplifies the output circuit and is shown in the block diagram of FIG. 4. This discharge lamp lighting device is made up from: diode bridge 1*a*, step-up/step-down converter 31, polarity switching circuit 32, start pulse generation circuit 33, control power supply circuit 34, and control unit 35. Diode bridge 1*a* implements full-wave rectification of commercial AC, step-down/step-up converter 31 steps-up and steps-down the voltage that has undergone full-wave rectification, and polarity switching circuit 32 is composed of switch elements Q5*a*-5*d* and switches the polarity of current that flows to discharge lamp 6*a*. In addition, start pulse generation circuit 33 generates high-voltage pulses to start the discharge lamp of load 6*a*.

Step-up/step-down converter 31 is made up from: switch element Q2, transformer T1, diode D2, and capacitor C2. Control unit 35 is made up from: detection circuit 41 for detecting the zero-cross of commercial AC, control circuit 42 for controlling step-up step-down converter 31, current detection circuit 43 for detecting the current of the discharge lamp by means of current detection resistor R4, start pulse control circuit 44 for controlling start pulse generation circuit 33, target current calculation circuit 45, and polarity switch control circuit 45 for controlling polarity switch circuit 32.

Explanation next regards the operation of this discharge lamp lighting device. First, when power is supplied from a commercial ac power supply, control power supply circuit 34 generates and supplies a control power supply for control unit 35, whereby control unit 35 begins operation. In control unit 35, start pulse control circuit 44 controls start pulse generation circuit 33 and applies a high-voltage pulse to the discharge lamp to light discharge lamp 6*a*.

When discharge lamp 6*a* lights up, current begins to flow to current detection resistor R4, and current detection circuit 43 detects this current. On the other hand, a target current is calculated in target current calculation circuit 45. Polarity switch control circuit 46 here compares the current that has been detected by current detection circuit 43 with the target current that has been calculated by target current calculation circuit 45, controls step-up/step-down converter 31 such that the detected current equals the target current, and controls feedback.

In step-up/step-down converter 31, switch element Q1 repeatedly turns ON and OFF at a high frequency of several tens of kHz, whereby current flows to the primary side of transformer T1 when switch element Q1 is in the ON state and energy is accumulated in transformer T1. On the other hand, when switch element Q1 is in the OFF state, the accumulated energy is discharged as power to the secondary side of transformer T1. The discharged power is a high frequency of several tens of kHz, and the high-frequency component is eliminated by diode D2 and capacitor C2 and supplied to the discharge lamp.

When the detected current of current detection circuit 43 is lower than the target current of target current calculation circuit 45, converter control circuit 42 increases the time interval of the ON state of switch element Q1 to increase the power that is discharged to the secondary side, whereby the current that flows to discharge lamp 6*a* increases. On the other hand, when the detected current is greater than the target current, converter control circuit 42 reduces the time interval of the ON state of switch element Q2, whereby the power that is discharged to the secondary side is decreased and the current that flows to discharge lamp 6*a* drops. By implementing these operations at high speed, control is effected such that the current of the discharge lamp matches the target current.

Polarity switch control circuit 46 next controls polarity switch circuit 32 such that the set of switch elements Q3*a* and Q3*d* and the set of switch elements Q3*c* and Q3*b* alternately turn ON, whereby the dc current that is supplied as output from step-up/step-down converter 31 is converted to an alternating current and flows to the discharge lamp. Detection circuit 41 here supplies a zero-cross detection signal when zero-volts is attained in the periodic change of the voltage in the commercial ac power supply.

Target current calculation circuit 45 receives the zero-cross detection signal from zero-cross detection circuit 41, and calculates the target current such that the target current value becomes small in the vicinities of 0° and 180° and the target current value becomes great in the vicinities of 90° and 270° with respect to the commercial ac voltage waveform. Control unit 35 receives the zero-cross detection signal from detection circuit 41, and switches the set of switch elements 5*a* and 5*d* that switch between the ON state and OFF state and switches the set of switch elements 5*c* and 5*b* that switch between the ON state and the OFF state.

In this way, the polarity of the current that flows to discharge lamp 6*a* switches at 0° and 180° to produce a sinusoidal current synchronized with the commercial ac power supply VAC. The current that flows from commercial ac power supply VAC to the discharge lamp lighting device and the current that flows to discharge lamp 6*a* are in a proportional relation, whereby the input current of the discharge lamp lighting device is also a sinusoidal current synchronized to the commercial ac power supply, and the input power factor is increased. In addition, because a power-factor improvement circuit such as a booster inverter is not required, a compact and inexpensive discharge lamp lighting device can be obtained.

However, power of 50-200 W was required for use as an illumination device in the above-described first example of the prior art. An illumination device of this level of power requires a power-factor improvement circuit. The output of this power-factor improvement circuit further becomes a constant current in the current limiting circuit, but as previously explained, this results in increased circuit scale and presents an obstacle to lowering costs.

In response to these problems, the present invention investigates the feasibility of providing a current-limiting capability to the power-factor improvement circuit. If this method is adopted, the time constant of the feedback of current that flows to a light-emitting device must be made sufficiently greater than the period of the ac power supply, and this requirement has the drawback of preventing following in the event of sudden changes in the current that flows to the light-emitting device. In addition, the ripple component of the ac power supply is carried by the light-emitting device current and therefore cannot be avoided, with the resulting drawback that a certain degree of luminous ripple occurs. Neither of these drawbacks occurs in a method in which a current control circuit is provided separately.

Although a lamp lighting device with a simplified output circuit was disclosed in the above-described second example of the prior art, this is a circuit for lighting a discharge lamp and therefore serves as an ac lighting device in which the polarity of the current that flows to the discharge lamp is switched by a polarity switching circuit. As a result, the switching of polarity must be implemented in synchronization with the frequency of the commercial power supply in order to improve the power factor, which is the chief objective, and the polarity switching is therefore an indispensable constituent technology. As a consequence, this device cannot be used as a device directed toward lighting an LED or organic EL that is a dc-driven element.

SUMMARY OF THE INVENTION

It is a chief object of the present invention to provide a compact and inexpensive low-voltage power supply circuit for illumination and an illumination device in which the load current is controlled to be substantially constant and in which a power factor close to 1 can be obtained.

As the configuration of the present invention, a low-voltage power supply circuit for illumination for supplying a low-voltage power supply for illumination includes: a rectifier circuit for rectifying an ac power supply; and a power-factor control circuit for controlling the rectified output from the rectifier circuit, the power-factor control circuit being composed of a step-down circuit, and moreover, being provided with a current-limiting capability.

The present invention may further include: a switch element that is both driven by the output of the rectifier circuit and the detected output of the power supply current and switched by the control output from the power-factor control circuit; a step-down transformer that is controlled by the output of the switch element; a simplified output circuit for both rectifying the output of the transformer and filtering the high-frequency component by means of a passive element; and a current detection circuit for obtaining the detected output of the power supply current from the output current of the simplified output circuit; wherein: one of the input terminals of the transformer can be connected to the output of the switch element and the other input terminal can be connected to the output of the rectifier circuit; and further, the power-factor control circuit: can compare the detected output of the load current with a prescribed reference value and amplify the error, multiply this amplified output with the output of the rectifier circuit, compare this multiplied output with a prescribed high-frequency signal, and drive the switch element by means of this comparison output; and further, the prescribed high-frequency signal can be composed of a saw-tooth-wave signal of 20-200 kHz.

In the configuration of the illumination device of the present invention, the illumination device is connected to a light source for illumination and uses the above-described low-voltage power supply circuit for illumination.

In the present invention, the light source for illumination can be a dc-lighted light source such as an organic EL or an LED.

According to the configuration of the low-voltage power supply output method for illumination according to the present invention: a rectifier circuit rectifies an ac power supply; a power-factor control circuit that is composed of a step-down circuit and that is further provided with a current-limiting capability controls the rectified output from the rectifier circuit; and a low-voltage power supply for illumination is supplied as output.

In the present invention, the power-factor control circuit is driven by means of the output of the rectifier circuit and the detected output of the power supply current; the switch element is switched and driven by means of the control output from the power-factor control circuit; the step-down transformer is controlled by means of the output of the switch element; the output of the transformer is rectified, and further, the high-frequency component is filtered by a passive element to supply a power supply current; and the detected output of the power supply current can be obtained from the power supply current. Further, the power-factor control circuit can compare the detected output of the load current with a prescribed reference value and amplify the error; multiply this amplified output with the output of the rectifier circuit; compare this multiplied output with a prescribed high-frequency signal; and drive the switch element by means of this comparison output.

In the configuration of the illumination method of the present invention, a light source for illumination is driven to produce illumination by a power supply output for illumination that is obtained by the above-described low-voltage power supply output method for illumination.

In the present invention, a delighted light source such as an organic EL or LED can be used for the above-described light source for illumination.

DETAILED DESCRIPTION OF THE PREFERRED EMBODIMENTS

Figure 1:
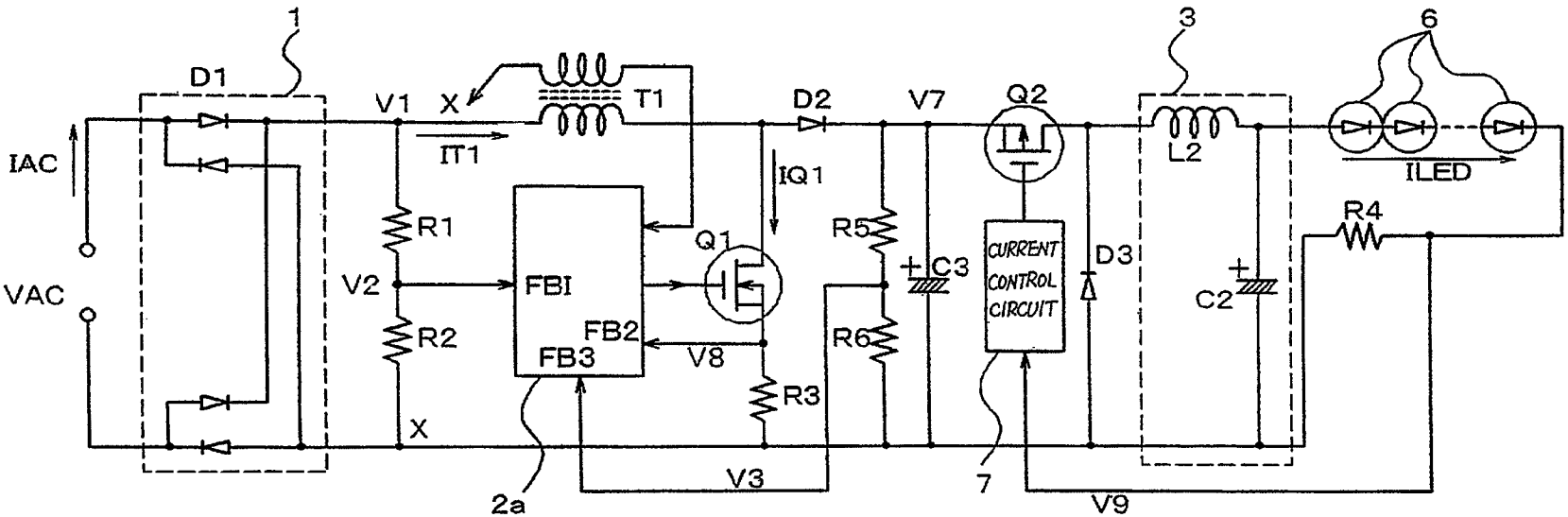
FIG. 1 is a block diagram for explaining a typical power supply circuit of the prior art.
Figure 2A:
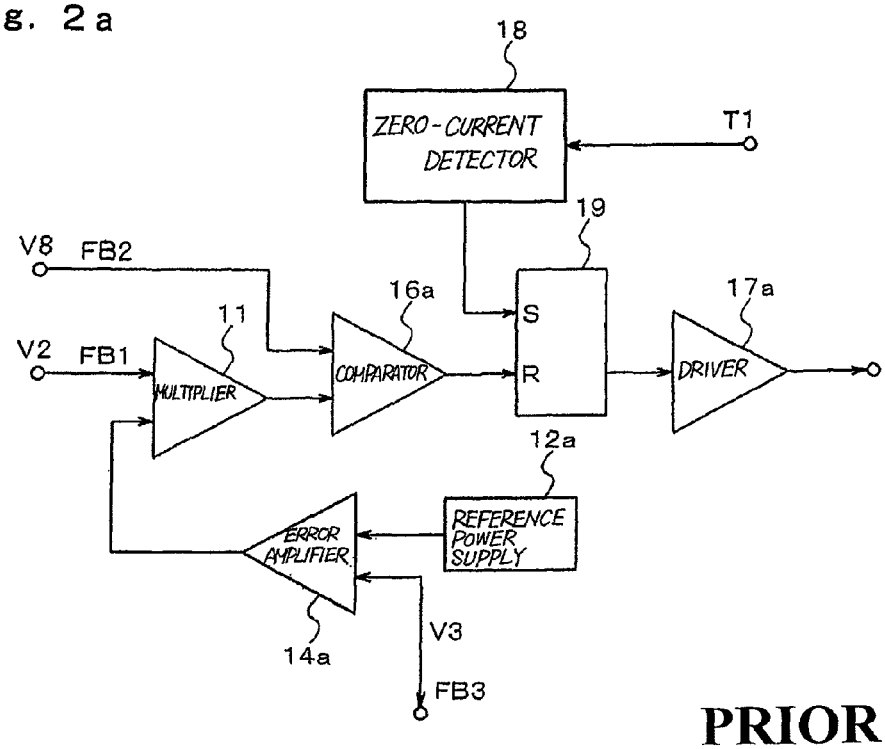
FIG. 2*a* is a block diagram of the power-factor improvement control circuit shown in FIG. 1.
Figure 2B:
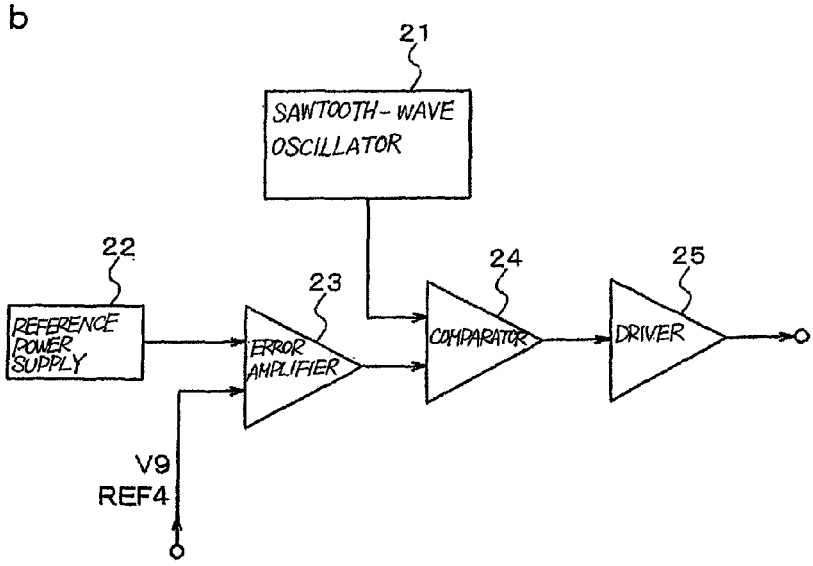
PRIOR ART Fig. 2b
FIG. 2*b* is a block diagram of the portion of the current control circuit shown in FIG. 1.
Figure 3A:
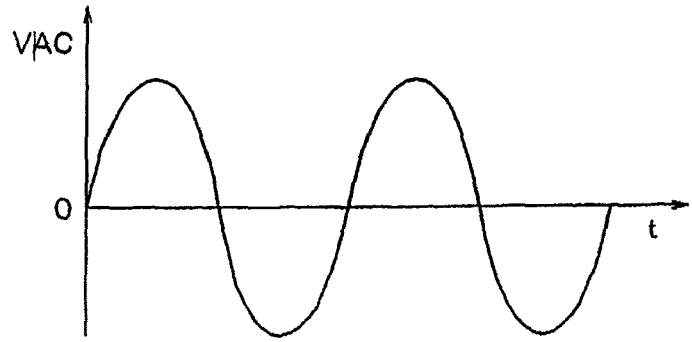
Fig. 3a PRIOR ART
FIG. 3*a* is a waveform chart for explaining the operation of FIGS. 2*a* and 2*b;*
Figure 3B:
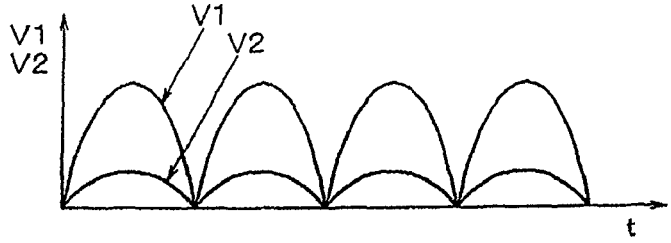
Fig. 3b PRIOR ART
FIG. 3*b* is a waveform chart for explaining the operation of FIGS. 2*a* and 2*b;*
Figure 3C:
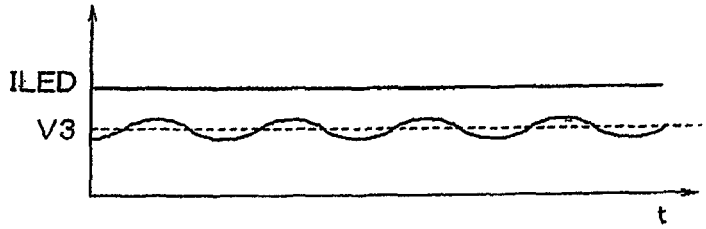
Fig. 3c PRIOR ART
FIG. 3*c* is a waveform chart for explaining the operation of FIGS. 2*a* and 2*b;*
Figure 3D:
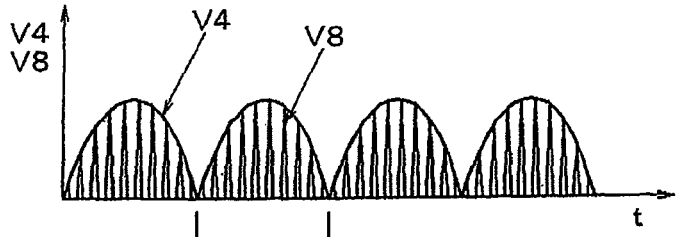
Fig. 3d PRIOR ART
FIG. 3*d* is a waveform chart for explaining the operation of FIGS. 2*a* and 2*b;*
Figure 3E:
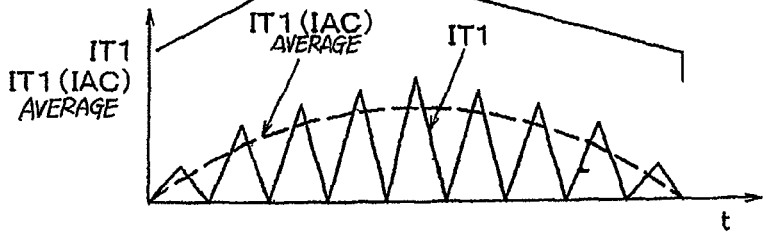
Fig. 3e PRIOR ART
FIG. 3*e* is a waveform chart for explaining the operation of FIGS. 2*a* and 2*b;*
Figure 3F:
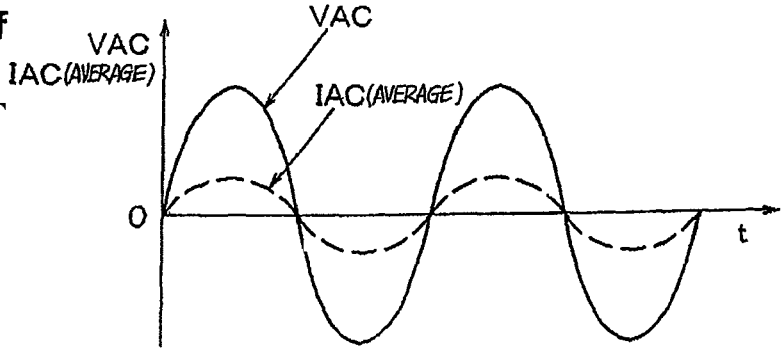
Fig. 3f PRIOR ART
FIG. 3*f* is a waveform chart for explaining the operation of FIGS. 2*a* and 2*b;*
Figure 4:
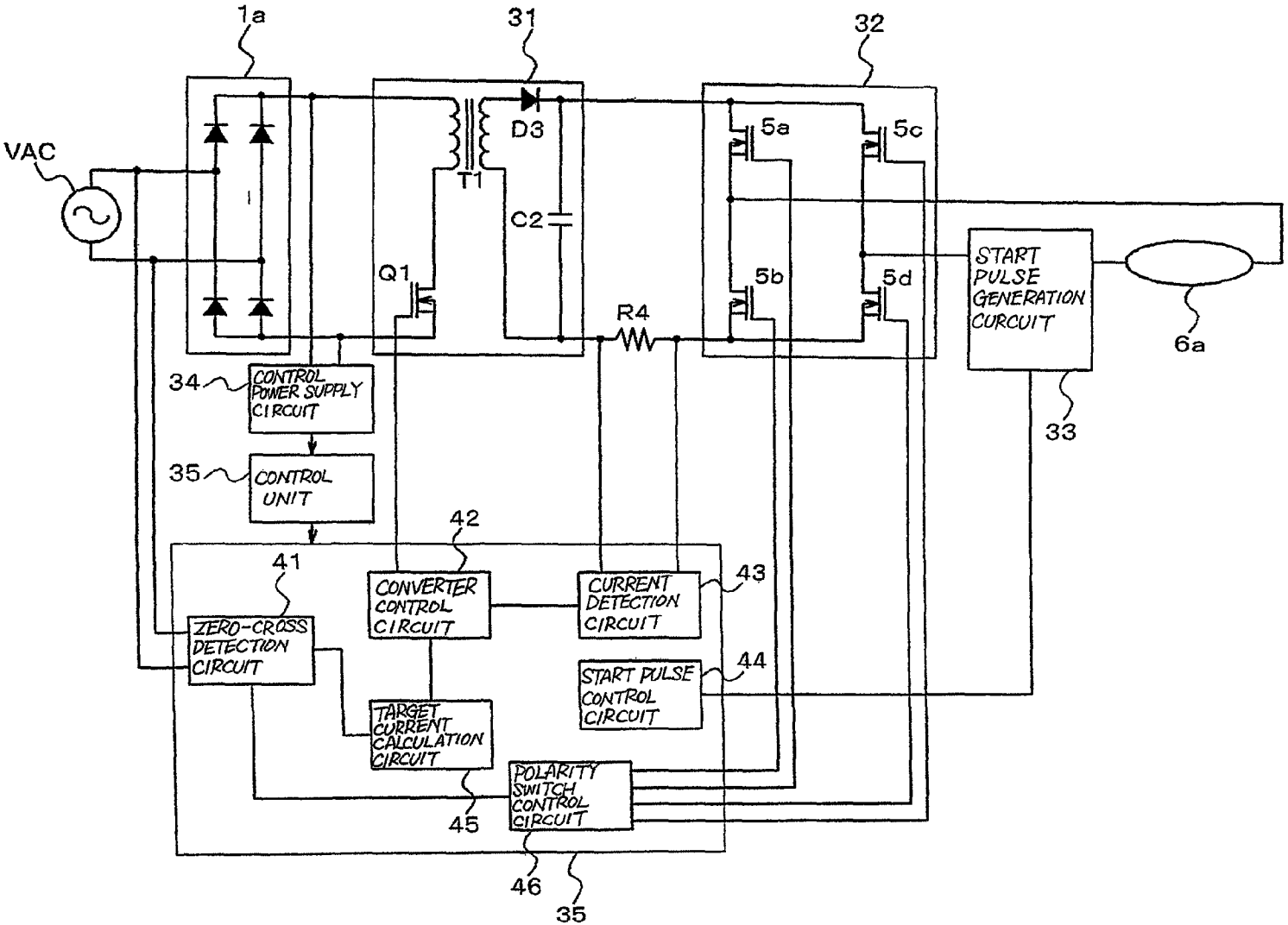
FIG. 4 is a block diagram for explaining another power supply circuit of the prior art.
Figure 5:
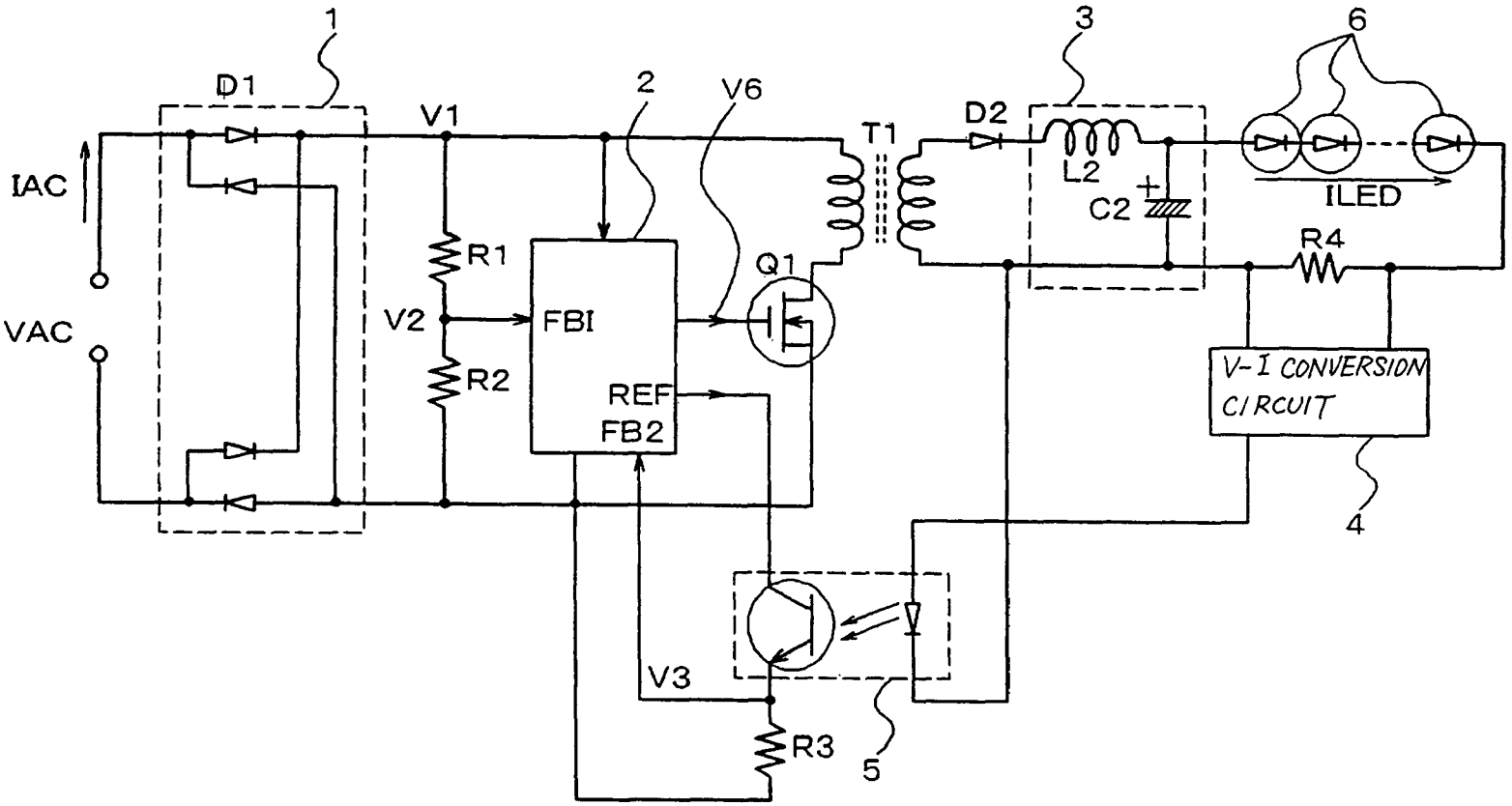
FIG. 5 is a block diagram of the power supply circuit for explaining the first embodiment of the present invention.

FIG. 5 is a block diagram of the power supply circuit for illumination of an embodiment of the present invention. FIGS. 6*a*-6*f* are waveform charts for explaining the operation of the power supply circuit for illumination of the embodiment. As shown in this FIG. 5, the driven element that is the object of the present embodiment should be a current-controlled light-emitting device such as an organic EL or LED that can be driven by direct current, and in the following explanation, an LED is the driven element.

As a characteristic of the present embodiment, step-down-type power-factor control circuit is provided with a capability for limiting the current that flows to an LED. In other words, the power supply circuit for illumination according to the present embodiment features a low-voltage power supply circuit for illumination that rectifies ac power supply VAC by means of rectifier circuit 1, controls this rectified output by means of power-factor control circuit 2, and supplies a low-voltage power supply for illumination, wherein power-factor control circuit 2 in the low-voltage power supply circuit for illumination is composed of a step-down circuit, and moreover, has the capability for limiting current.

When, in a current-controlled light-emitting device such as an organic EL or LED, a constant current is applied to the LED or EL, the output value is determined by the forward voltage drop held by these elements, and the output voltage therefore does not have to be fed back for control.

The control of the rectified output by means of power-factor control circuit 2 involves driving power-factor control circuit 2 by the output of a rectifier circuit and the detected output of the power supply current and then supplying as output a low-voltage power supply for illumination. In addition, the current-limiting capability of power-factor control circuit 2 involves comparing the detected output of the power supply current with a prescribed reference value and driving power-factor control circuit 2 to supply a low-voltage power supply for illumination in which the output current is controlled to a constant level.

The power supply circuit for illumination of the present embodiment further includes: power-factor control circuit 2; switch element Q1 that is switched by means of control output from this power-factor control circuit 2; step-down transformer T1 that is controlled by the output of this switch element Q1; simplified output circuit (diode D2 and output filter 3) for rectifying the output of this transformer T1 by means of diode D2, and moreover, filtering the high-frequency component by means of a passive element (inductor L2 and capacitor C2); and, current detection circuit (resistor R4 and V-I conversion circuit 4) for obtaining detected output of the power supply current from the output current of this simplified output circuit.

The principal parts of this power supply circuit for illumination of FIG. 5 are composed of: diode bridge 1, transformer T1, switch element Q1, power-factor control circuit 2 for controlling this switch element Q1, diode D2, output filter 3, V-I conversion circuit 4, and photocoupler 5.

In FIG. 5, ac power supply VAC (FIG. 6*a*) is first subjected to full-wave rectification by means of diode bridge 1. This full-wave rectification output V1 is connected to one end of switch element Q1 by way of the primary coil of transformer T1. In addition, power-factor control circuit 2 is composed of a control IC, and by controlling the switching interval of switch element Q1, controls the phase of ac power supply VAC and power supply current IAC that flows to this ac power supply VAC to thus improve the power factor. Switch element Q1 is ON/OFF-controlled by means of power-factor control circuit 2 and implements intermittent connection of the primary current of transformer T1. Transformer T1 both conveys to the secondary side the energy resulting from the intermittently connected primary current and generates voltage in the secondary coil at the boost ratio that corresponds to the ratio of the primary coil and secondary coil.

Figure 6A:
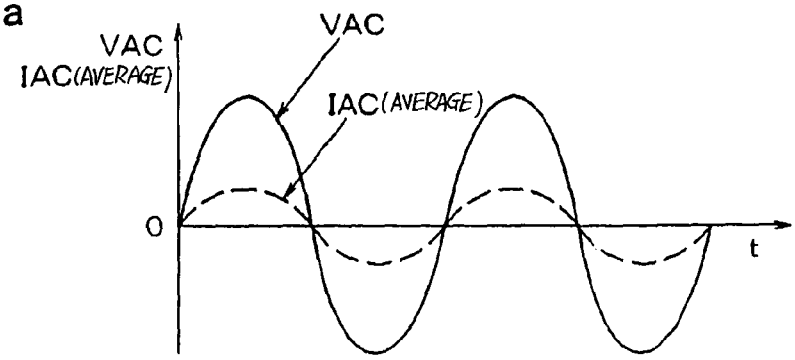
FIG. 6*a* is a waveform chart for explaining the operation of FIG. 5.
Figure 6B:
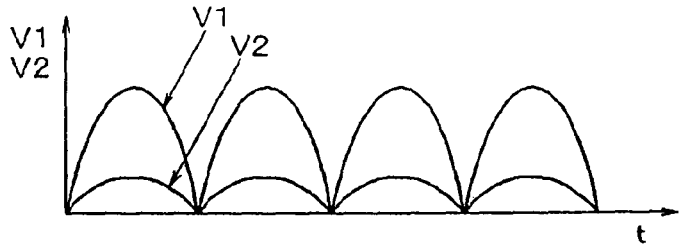
FIG. 6*b* is a waveform chart for explaining the operation of FIG. 5.
Figure 6C:
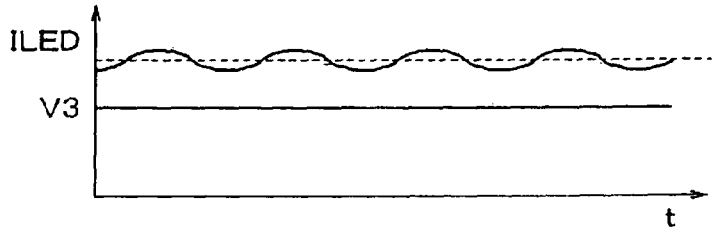
FIG. 6*c* is a waveform chart for explaining the operation of FIG. 5.
Figure 6D:
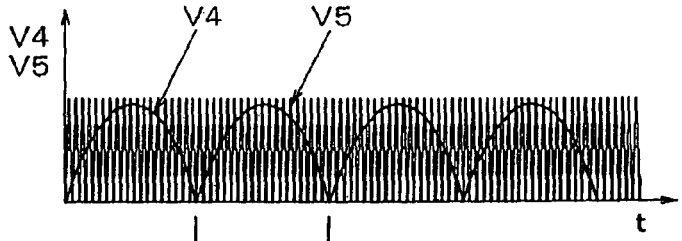
FIG. 6*d* is a waveform chart for explaining the operation of FIG. 5.
Figure 6E:
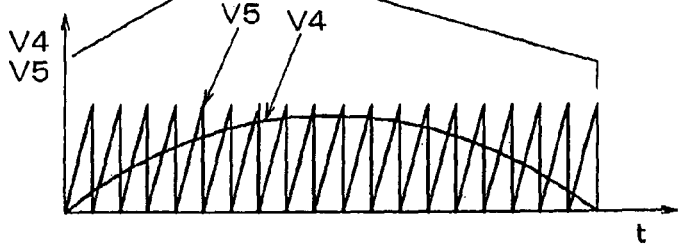
FIG. 6*e* is a waveform chart for explaining the operation of FIG. 5.

Full-wave rectified voltage V1 that has undergone rectification by diode bridge 1 is voltage-divided to an appropriate value by resistor R1 and resistor R2, and this voltage-divided voltage V2 is supplied to terminal FB1 of power-factor control circuit 2 (FIG. 6*b*).

The secondary voltage of transformer T1 undergoes rectification by means of diode D2. This rectified output is further supplied to the LED of load 6 by way of output filter 3 that is composed of inductor L2 and capacitor C2. Output filter 3 converts the rectified voltage to a direct current having a low level of ripple.

The LED of load 6 is a light-emitting diode that is the light source of the illumination device, and a single LED or plurality of serially connected LEDs may be used. Resistor R4 is provided in the feedback line of load 6, resistor R4 being provided for detecting current ILED that flows to the LED. The output that is detected at this load 6 (the voltage across the two ends of resistor R4) is converted to a current at V-I conversion circuit 5 and then fed back by way of photocoupler 5 as feedback voltage V3 (FIG. 6*c*) to terminal FB2 of power-factor control circuit 2.

Photocoupler 5 that is serially connected to resistor R3 is supplied with a reference voltage from terminal REF of power-factor control circuit 2 and supplies feedback voltage V3 from its serial connection terminal to terminal FB2 of power-factor control circuit 2. Power-factor control circuit 2 receives this voltage-divided voltage V2 and feedback voltage V3 and controls switch element Q1.

As shown in FIG. 5, the low-voltage power supply circuit for illumination of the present embodiment connects the low-voltage power supply output for illumination to the LED of load 6 and supplies an ac power supply. The LED is driven by the low-voltage power supply output for illumination from this low-voltage power supply circuit for illumination, whereupon the LED can be caused to emit light and used as an illumination device.

As the low-voltage power supply output method for illumination of the present embodiment, an ac power supply is rectified by means of rectifier circuit 1, and this rectified output is controlled by means of power-factor control circuit 2 to enable supply as output of a low-voltage power supply for illumination. As the illumination method, the power supply output for illumination that is obtained by the above-described power supply output method for illumination is used to drive the light source for illumination to enable illumination.

In the present embodiment, power-factor control circuit 2 of the power supply circuit is both made the step-down type and provided with a current-limiting capability. This type of configuration normally dictates that the time constant of the feedback of the current that flows to the light-emitting device be made sufficiently greater than the period of the ac power supply, and as a result, the problem arises that following cannot be realized upon sudden changes of the current that flows to the light-emitting device. As a further problem, the ripple component of the ac power supply is inevitably carried on the light-emitting device current, and a certain amount of luminance ripple must therefore occur. However, considering that this device is used as an illumination device at constant luminance, the occurrence of sudden changes in the light-emitting device current is unlikely, and the occurrence of a certain amount of luminance ripple therefore poses no serious obstacle to the practicality of the power supply circuit, and the present embodiment can therefore offer a simplified configuration with a reduction in costs.

Power-factor improvement circuit 2 normally feeds back the output voltage to operate such that the output voltage is maintained at a substantially constant value, but in the present embodiment, this feedback is made only the feedback of the current value, and therefore enables a simplified configuration.

A booster-type circuit has been used in the power-factor control circuit of the prior art. In such a case, the output voltage of the power-factor control circuit is higher than the maximum instantaneous value of the ac power supply voltage, and is suitable for a lighting circuit that requires a high voltage such as a fluorescent lamp. However, this type of device is not appropriate for driving a low-voltage element such as an LED or organic EL, and a circuit was therefore required in a stage following the power-factor improvement circuit for lowering the voltage to a voltage appropriate to these loads.

In the present embodiment, a step-down circuit is used as power-factor control circuit 2, and a separate circuit for lowering the voltage is therefore not needed, and moreover, power-factor control circuit 2 is further provided with the capability for limiting the current that flows to the load LED to a constant level, and the circuit can therefore be simplified.

Thus, in the present embodiment, a signal that accords with the magnitude of the current ILED that flows to the load LED that is the light source is fed back to the control circuit at the same time that the power factor is controlled, whereby the power supply circuit according to the present embodiment operates to both improve the power factor and cause a current of a constantly fixed magnitude to flow to the LED. By means of this configuration, a current-limiting circuit for limiting the current of the LED need not be separately provided, and a compact and low-cost power supply circuit for an LED illumination device can therefore be constructed.

According to the present embodiment, a desired LED illumination device can be realized by a less complex circuit configuration without the need to provide a separate current-limiting circuit, and as a result, a compact and low-cost power supply circuit for an LED illumination device can be realized.

In addition, the provision of a power-factor improvement circuit allows the power supply current to be kept to a low level and enables reduction of the load upon the power supply wiring even in the case of a high-output illumination device.

FIRST WORKING EXAMPLE

Figure 7:
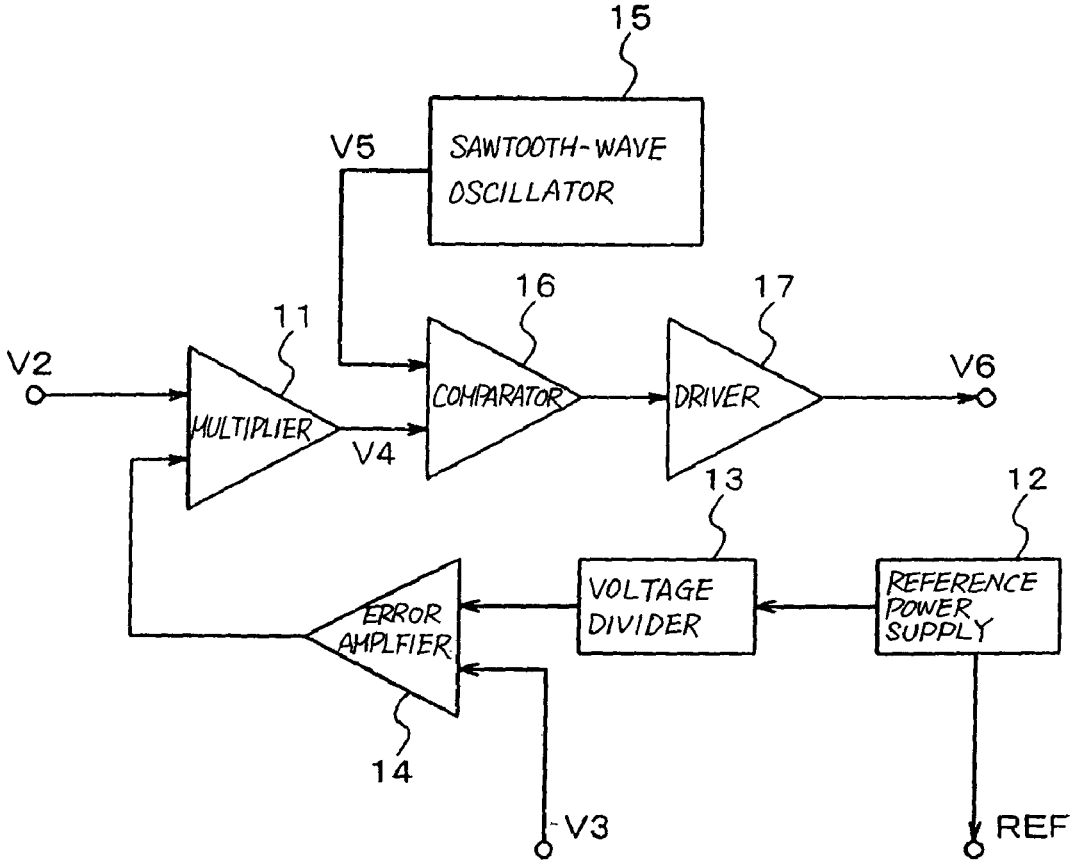
FIG. 7 is a block diagram of an actual example of a portion of the power-factor improvement control circuit shown in FIG. 5.

In the embodiment of FIG. 5, the device for which the details of power-factor control circuit 2 used in FIG. 5 were described was the first working example. FIG. 7 is a block diagram for explaining a working example of power-factor control circuit 2 used in FIG. 5. This power-factor control circuit 2 is made up from: multiplier 11, reference power supply 12, voltage divider 13, error amplifier 14, sawtooth-wave oscillator 15, comparator 16, and driver 17. In this working example, power-factor control circuit 2 compares the detected output of the load current with a prescribed reference value in error amplifier 14 and amplifies this error; multiplies this amplified output with the output of a rectifier in multiplier 11 circuit, compares this multiplied output with a prescribed high-frequency signal in comparator 16, and then drives switch element Q1 by this comparison output.

Explanation next regards the details of the operation of the power supply circuit according to the present working example using FIGS. 5-7. After current ILED that flows to load 6 has been detected by measuring the voltage across the two ends of resistor R4, the current is applied as feedback voltage V3 (FIG. 6*c*) by way of V-I conversion circuit 4 and photocoupler 5 to power-factor control circuit 2. This feedback voltage V3 is compared with the reference voltage by means of error amplifier 14, and the difference in voltage is then amplified and applied to one input terminal of multiplier 11. Voltage-divided voltage V2 is applied to the other input terminal of multiplier 11. Multiplier 11 generates voltage V4 obtained by multiplying these voltages and supplies this result to one of the terminals of comparator 16. Output V4 of multiplier 11 is accordingly a voltage that resembles ac power supply voltage VAC and that has amplitude proportional to current ILED that flows to the LED (V4 of FIG. 6*d* and FIG. 6*e*).

Figure 6F:
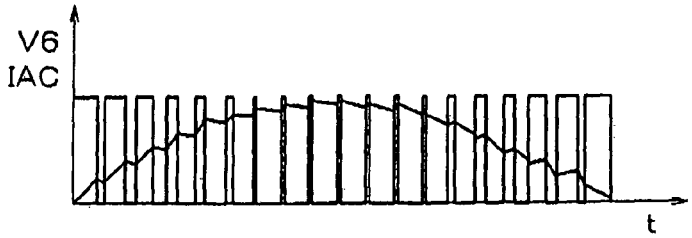
FIG. 6*f* is a waveform chart for explaining the operation of FIG. 5.

A sawtooth wave having a fixed period and amplitude (V5 in FIGS. 6*d* and 6*e*) that has been generated in sawtooth-wave generator 15 is applied to the other terminal of comparator 16. The frequency of this sawtooth wave is normally 20-200 kHz, as in the example of the prior art. In comparator 16, these input voltages are compared and a pulse that has undergone pulse-width modulation generated as output. The output of comparator 16 is power-amplified by driver 17 and then drives the gate of switch element Q1 (FIG. 6*f*). Switch element Q1 therefore intermittently connects the current that flows to transformer T1 by a pulse signal that has been generated and undergone pulse-width modulation by comparator 16.

By means of this configuration, the average value of the current that flows to the primary side of transformer T1, i.e., the phase of input current IAC of the ac power supply, comes extremely close to the phase of ac voltage VAC and the power factor approaches "1."

As shown in FIG. 6*a*, voltage V2 that is applied to terminal FB1 of power-factor control circuit 2 is a half-wave rectified waveform of the same phase as power supply voltage VAC. In addition, as shown in FIG. 6*b*, current ILED is substantially a dc current. As a result, feedback signal V3 that corresponds to current ILED is also substantially a dc voltage. Voltage V2 and voltage V3 are multiplied in multiplier 11 within power-factor control circuit 2, then compared with voltage V5 in comparator 16, and then supplied from GATE terminal as a signal for switching switch element Q1. Essentially, voltage V3 and voltage V2 are fed back to power-factor control circuit 2, but by setting the time constant of the feedback of voltage V3 to a large value and setting the time constant of the feedback of voltage V2 to a small value, operation is realized such that voltage V2 is followed in short time span and voltage V3 in a long time span and average current ILED is kept at a fixed value.

On average, current IAC in which the phase matches power supply voltage VAC flows as the power supply current as shown in FIG. 6*a*, and the power factor thus becomes a value that substantially approaches "1." In addition, a substantially constant desired current flows to the LED.

SECOND WORKING EXAMPLE

In the first working example of FIG. 5, a FET was shown as switch element Q1, and photocoupler 5 that incorporates an LED and phototransistor was shown as the transmission element of the feedback signal. As another working example, a switch element such as a transistor or IGBT (Insulated-Gate Bipolar Transistor) can also be applied as switch element Q1. Alternatively, if a light-emitting device and a photodetection element can be electrically insulated and signals can be transmitted, the light-emitting device and photodetection element can be applied in place of a photocoupler regardless of the type of light-emitting device and photodetection element. In the working example of FIG. 5, the primary side and secondary side are electrically isolated by means of transformer T1 and photocoupler 5. Although this separation prioritizes ease-of-use, this separation is not an indispensable element for realizing the functions of the present working example.

According to the configuration of the present invention as described in the foregoing explanation, the current that flows to the load is fed back to the step-down power-factor control circuit, and this power-factor control circuit is provided with a capability for limiting the current that flows to the load, and as a result, a circuit for limiting the current that flows to the load need not be separately provided. A compact and low-cost low-voltage power supply circuit for illumination and an illumination device can therefore be constructed.

The present invention can be applied to the power supply device of an illumination device that uses an organic EL or LED as a light source. In addition, although few examples of commercialized devices exist at present, it can be expected that these devices will find wide application in the future for reading/writing lamps, guide lamps, decorative illumination, as well as for general household illumination devices and store illumination that substitute for fluorescent lamps.

When this light source is used as an illumination device, the characteristics demanded of the power supply device include: (1) an ac power supply; (2) a power-factor improvement circuit that is necessary when the power supply current is high; and further, (3) small size and low cost. The present invention makes possible a low-voltage power supply circuit for illumination and an illumination device that meet these conditions.

What is claimed is:

1. A low-voltage power supply circuit for supplying a low-voltage power supply for illumination, comprising:

a rectifier circuit for rectifying an ac power supply;

a power-factor control circuit for controlling rectified output from said rectifier circuit, said power-factor control circuit being composed of a step-down circuit, and moreover, being provided with a current-limiting capability, a switch element that is both driven by the output of said rectifier circuit and the detected output of a power supply current and switched by the control output from said power-factor control circuit;

a step-down transformer that is controlled by the output of said switch element;

a output circuit for both rectifying the output of said transformer and filtering the high-frequency component by means of a passive element; and a current detection circuit for obtaining the detected output of said power supply current from the output current of said simplified output circuit.

2. A low-voltage power supply circuit for illumination according to claim 1, wherein:

one of the input terminals of said transformer is connected to the output of said switch element, and the other input terminal is connected to the output of said rectifier circuit.

3. A low-voltage power supply circuit for illumination according to claim 1, wherein said power-factor control circuit:

compares the detected output of a load current with a prescribed reference value and amplifies the error;

multiplies this amplified output with the output of said rectifier circuit;

compares this multiplied output with a prescribed high-frequency signal; and drives a switch element by means of this comparison output.

4. A low-voltage power supply circuit for illumination according to claim 2, wherein said power-factor control circuit:

compares the detected output of a load current with a prescribed reference value and amplifies the error;

multiplies this amplified output with the output of said rectifier circuit;

compares this multiplied output with a prescribed high-frequency signal; and drives a switch element by means of this comparison output.

5. A low-voltage power supply circuit for illumination according to claim 3, wherein said prescribed high-frequency signal is composed of a sawtooth-wave signal of 20-200 kHz.

6. A low-voltage power supply circuit for illumination according to claim 4, wherein said prescribed high-frequency signal is composed of a sawtooth-wave signal of 20-200 kHz.

7. An illumination device that uses the low-voltage power supply circuit for illumination according to claim 1 that is connected to a light source for illumination.

8. An illumination device according to claim 7, wherein said light source for illumination is a dc-lighted light source such as an organic EL or an LED.

* * * * *